United States Patent [19]

Schulz

[11] Patent Number: 4,874,141

[45] Date of Patent: Oct. 17, 1989

[54] FREEZER BAG SUPPORTING STAND

[76] Inventor: Richard H. Schulz, 845 N. L Street, Livermore, Calif. 94550

[21] Appl. No.: 277,202

[22] Filed: Nov. 29, 1988

Related U.S. Application Data

[63] Continuation-in-part of Ser. No. 126,640, Nov. 30, 1987, abandoned.

[51] Int. Cl.[4] ..... A63B 55/04

[52] U.S. Cl. ..... 248/97; 248/99

[58] Field of Search ..... 248/153, 150, 97, 101, 248/99; 206/223, 216; 53/384; 383/33; 220/404, 406

[56] References Cited

U.S. PATENT DOCUMENTS

| | | | |
|---|---|---|---|
| 645,199 | 3/1900 | Brooks | 248/97 |
| 1,015,621 | 1/1912 | Hanson | 248/97 |
| 1,397,898 | 11/1921 | O'Brien | 248/97 |
| 1,542,164 | 6/1925 | Nelson | 248/97 |
| 2,235,986 | 3/1941 | Ellingson | 248/153 |
| 3,610,560 | 10/1971 | Dillabough | 248/153 X |
| 3,847,332 | 11/1974 | Murai | 248/99 |
| 3,866,872 | 2/1975 | Burgess | 248/101 X |
| 4,283,032 | 8/1981 | Smith | 206/223 X |
| 4,759,519 | 7/1988 | Cheng | 248/99 |

FOREIGN PATENT DOCUMENTS

| | | | |
|---|---|---|---|
| 2325605 | 12/1974 | Fed. Rep. of Germany | 248/97 |
| 4078 | of 1908 | United Kingdom | 248/97 |

*Primary Examiner*—J. Franklin Foss

*Attorney, Agent, or Firm*—Burns, Doane, Swecker & Mathis

[57] ABSTRACT

A stand for supporting bags including a base, a flexible stanchion, and a bag-engaging collar which is generally C-shaped and capable of being pinched together for insertion into a bag to be supported, loading of such a bag progressively bending the stanchion, the collar, stanchion and base maintaining such a bag in column to prevent spillage and to allow easy removal of the collar upon springback of the stanchion when the collar is again pinched together.

4 Claims, 1 Drawing Sheet

FREEZER BAG SUPPORTING STAND

RELATED MATERIALS

This application is a continuation-in-part of U.S. patent application Ser. No. 126,640 filed Nov. 30, 1987 now abandoned.

BACKGROUND OF THE INVENTION

1. Field of the Invention

The invention relates to supporting devices for freezer bags and like flexible containers or receptacles.

2. Background Art

In the past, stands have been developed to temporarily position and secure a bag in an open position for the purpose of filling the bag. Unfortunately, such devices are rigid, awkward to use and not easily storable between times of use.

Several devices exist to position and secure a bag for filling purposes. For example, British Patent Specification No. 4078 discloses a sack holder having a platform, vertical standard and spring hoop wherein the open end of a sack may be pulled over the hoop with the body of the sack resting on the platform. The disadvantages of such a device are that it is a rigid structure that is not adaptable or self-adjustable to bags of different sizes and that it requires great effort to secure the open end of the bag or sack to the device.

U.S. Pat. No. 1,015,621 discloses a bag holder for supporting two bags with circumferentially expanding bands having prongs, the bands trapping the bags with the prongs. Unfortunately, the bands and prongs must provide the entire support for the bags and are, therefore, an obstacle upon removal of the bags. Loaded bags further require support by some external means during the complicated task of removing the bags from the holder.

U.S. Pat. No. 645,199 discloses a bag holder having an unadjustable standard (similar to the above-described British reference) and a ring having a series of pins to engage the bag (similar to the abovementioned U.S. patent). Such a mechanism has the shortcomings of both of the above-described devices.

Several bag holders have been developed which have a supporting stand and ring-shaped bag-holding portions to which a bag is clipped. See, for example, U.S. Pat. Nos. 1,397,898, 1,542,164, 2,235,986, 3,610,560, 3,866,872, 4,283,032 and German Patent No. 2,325,605. Although some of these devices are vertically adjustable, and almost all of these devices allow for the weight of the load to be partially supported by the counter surface, none of these devices or those described earlier provides a stand which easily engages and opens bags of varying size allowing filling of the bags wherein the engaging portion moves upon loading of the bag to maintain the bag in column, the bag then being supported primarily by the base or counter surface, the bag-engaging portion being readily removable, and wherein the stand is easily disassembled for cleaning and storage.

SUMMARY OF THE INVENTION

The purpose of the instant invention is to provide a stand which is light and inexpensive, which facilitates filling a collapsible bag, preferably a freezer bag, and which, upon separation of the bag from the stand, minimizes spillage of the contents of the bag. To accomplish this purpose there is provided a base, a flexible stanchion, and a bag-engaging collar which is generally C-shaped, the bag-engaging collar being compressible and insertable into the opening of a bag to be supported, loading of the bag causing flexing and bending of the stanchion, the collar and the stanchion maintaining the loaded bag in column with the weight of the loaded bag primarily supported upon the base, the collar being compressible for easy removal from the loaded bag by springback and straightening of the stanchion leaving the loaded bag in an upright position after removal from the stand.

In one aspect of the invention there is provided a stand for supporting bags comprising: a base, said base being generally horizontally oriented; a stanchion connected to said base, the stanchion being flexible and capable of bending; and a bag-engaging collar which is generally C-shaped and generally horizontally oriented and connected to said stanchion, said collar having a center section interconnected with said stanchion and ends, movement of the ends by hand manipulation inwardly toward each other allowing insertion of the collar within the mouth of a bag to be supported, the collar opening outwardly to engage the inside of a bag to be supported, loading of a bag bending the stanchion gradually upon loading, the collar remaining generally horizontal to avoid spillage, the collar and the bending of the stanchion maintaining a bag in column and supporting a bag primarily upon said base, movement of the ends and spring-back of the stanchion allowing easy removal of the collar from a loaded bag.

DESCRIPTION OF THE PREFERRED EMBODIMENT

Figure 1:
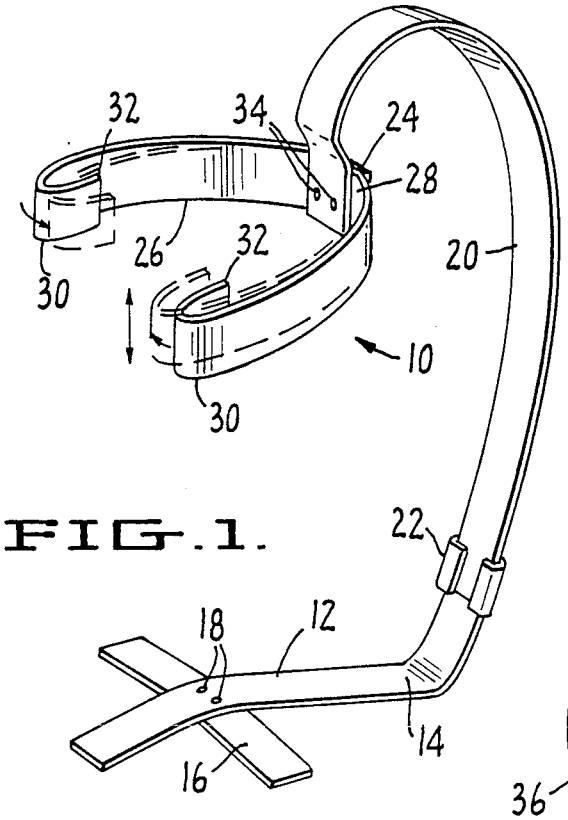
FIG. 1 is a perspective view of the stand of the instant invention wherein the ends of a bag-engaging collar may be moved inwardly, as shown in phantom, for the purpose of attachment to a bag.

With continued reference to the drawing, FIG. 1 illustrates a stand, shown generally at 10, for supporting a collapsible bag, preferably a food or freezer bag (not shown). Stand 10 comprises a base 12 which is generally horizontally oriented which is set upon a counter surface. Base 12 preferably includes member 14 and cross-member 16 which are shown to be fastened together by conventional fasteners 18. Although fasteners 18 are shown to be rivets, any fastening means such as welding, soldering, adhesives, etc., are within the scope of the invention. It is also within the scope of the invention to have the cross-member 16 removably connected to the member 14, as is disclosed with respect to the alternate embodiment shown in FIG. 4. Member 14 is preferably bent upwardly at one end thereof to connect with stanchion 20. It is within the scope of the invention to have the stanchion and base interconnect at points other than as shown, provided the base provide support and the stanchion be capable of flexing and bending.

Stanchion 20 is connected to base 12 by connector 22 which is shown to be a clip which holds the stanchion 20 and member 14 together. Other means of removably fastening the stanchion to the base are also within the scope of the invention, such as the clip arrangement shown in FIG. 4. It is important that stanchion 20 be flexible and capable of bending upon loading of a bag, the loaded bag being primarily supported by the stand 10. Stanchion 20 is preferably J-shaped and terminates in collar attachment portion 24 having a downwardly extending portion that can extend into a bag to be supported.

Figure 2:
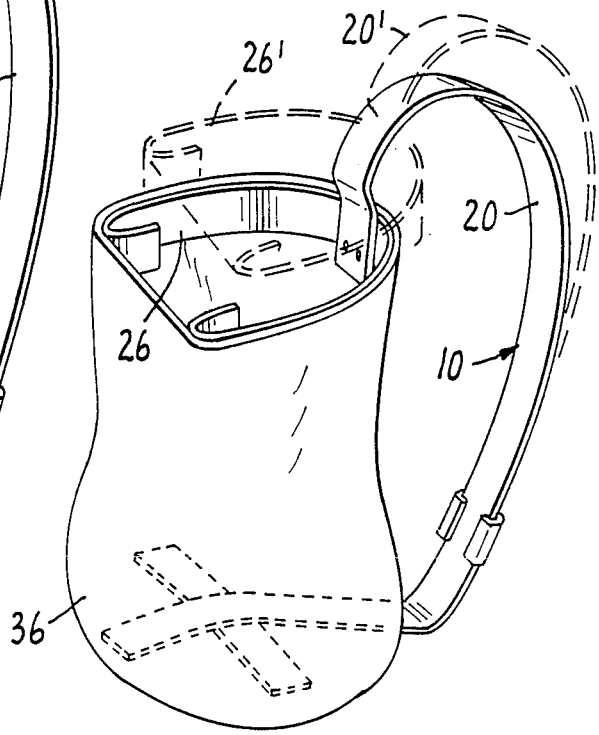
FIG. 2 illustrates the stand of FIG. 1 securing a collapsible bag that has been loaded. Removal of the bag-engaging collar by pinching the ends of the collar and straightening the supporting stanchion is shown in phantom.

A bag-engaging collar 26, which is generally C-shaped and generally horizontally oriented, is connected by collar-attaching portion 24 of stanchion 20. Collar-attaching portion 24 of stanchion 20 is shown to be a U-shaped clip into which the collar 26 is secured. It is understood that it is within the scope of the invention to have other preferably releasable fastening means associated with either or both the collar 26 and the stanchion 20 to secure the components together in operation. Collar 26 has a center section 28 which is positioned within the collar-attaching portion 24. Collar 26 also has ends 30 which are preferably bent inwardly at 32 so that the ends 30 may be pinched by single hand manipulation and moved toward each other thus allowing insertion and removal of the collar 26 within the mouth of a bag to be supported. It should be noted i FIG. 1 and in FIG. 3 that collar 26 is additionally secured at center portion 28 to collar-engaging portion 24 by complementary detents 34 in the collar 26 and the stanchion 20. In FIG. 1, movement of the collar 26 by pinching the ends 30 is shown in phantom. The collar 26 remains "generally horizontally oriented" during use of the stand 10. As can be seen in FIGS. 1 and 2 the collar 26 is angled upwardly relative to horizontal when unloaded (in phantom line in FIG. 2) and is essentially horizontal when engaging and supporting a loaded bag allowing filling of the bag without spillage and easy removal of the collar after filling. The slight variation in angle of the collar 26 is understood to be within the meaning of being "generally horizontally oriented".

It can be seen that all of the components of the stand 10 can be made from light and inexpensive flat stock material such as aluminum, plastic, or other suitable material which can be bent, formed or molded into the required shape. It can also be seen that the entire stand 10 may be easily disassembled for storage. The embodiment shown in FIG. 4 can be further disassembled, as will be discussed later.

FIG. 2 illustrates stand 10 after engagement with a collapsible bag 36. The figure shows that loading of the bag 36 causes bending of the stanchion 20, the collar 26 and the stanchion 20 maintaining the loaded bag in column and allowing the weight of the loaded bag to be supported primarily upon the base 12 and the counter surface upon which the base 12 rests. The collar 26 remains generally horizontally oriented during loading of the bag to prevent spillage. As seen in phantom, collar 26 has been pinched at its ends closing its general C-shape sufficiently to disengage from the inside of the bag and allowing the stanchion 20 to recover, i.e., straighten, thus moving the supporting structure from the bag. As mentioned earlier, it s understood that filling a bag causes the gradual bending of stanchion 20.

Figure 3:
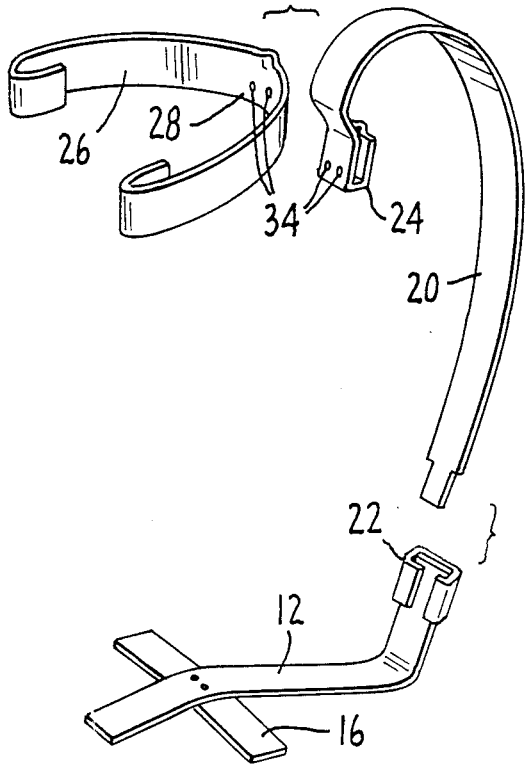
FIG. 3 is an exploded view similar to FIG. 1 illustrating disassembly of the stand shown in FIGS. 1 and 2.

FIG. 3 is an exploded view of the stand 10 shown in FIG. 1 illustrating the detachability of the base 12, stanchion 20 and collar 26.

Figure 4:
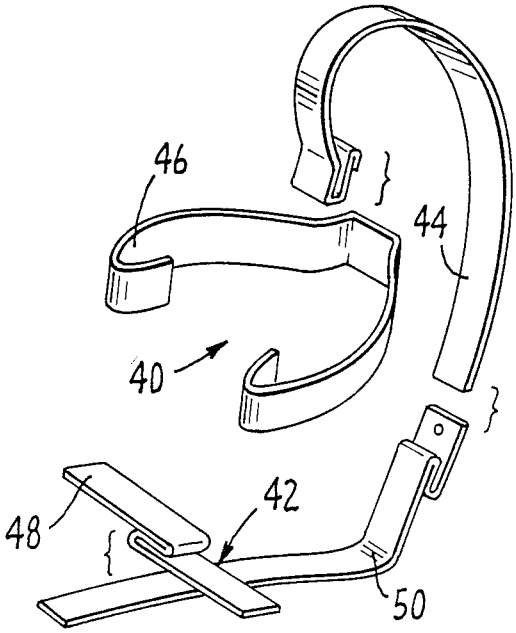
FIG. 4 is an exploded view similar to FIG. 3 of an alternate embodiment of the stand having a different form of component interconnection allowing further disassembly of the stand for the purpose of stand storage.

FIG. 4 illustrates a similar exploded view of an alternative embodiment of a stand 10, shown generally at 40, having a base, shown generally at 42, a stanchion 44, and a bag-engaging collar 46. In this embodiment, the base 42 may be disassembled for storage purposes. The base 42 includes a cross-member 48, a support member 50 is removably connected to stanchion 44, and stanchion 44 is removably connected to collar 46.

It can be seen that the present invention generally comprises a thin, flat, flexible framework for supporting a freezer bag in an open and vertical position thus freeing the user's hands for filling the bag. The three-section makeup of the structure is convenient for storage. The top section, referred to as the collar, can be compressed and inserted into a freezer bag, the collar springing back upon release and holding the bag in an open position. Freezer bags have locking strips which rest against the thin edge of the collar thus preventing separation of the bag from the collar as the bag is filled. The center section or stanchion of the stand preferably comprises a curved member joined at one end to the collar, the stanchion starting from a position inside the bag circling the outside of the freezer bag on one side of the bag, the stanchion bending as the bag is filled, thus settling the bag over the bottom section called the base. This bending of the stanchion adds stability to the framework as the weight of the bag increases, the bag settling firmly on the base and counter surface upon which the base rests.

Although the present invention has been described with particular reference to the preferred embodiments, such disclosure should not be interpreted as limiting. Various alterations and modifications will, no doubt, become apparent to those skilled in the art after having read the preceding disclosure.

What is claimed is:

1. A stand for supporting bags comprising:

a base, said base being generally horizontally oriented;

a stanchion connected to said base, said stanchion being J-shaped having one end thereof extending into a bag to be supported, said stanchion being generally curved along the length thereof and being flexible and capable of arcing and bending; and a bag-engaging collar which is generally C-shaped and generally horizontally oriented and connected to said stanchion, said collar having a center section interconnected with said stanchion and ends, movement of said ends by hand manipulation inwardly toward each other allowing insertion of said collar within the mouth of a bag to be supported, said collar opening outwardly to engage the inside of a bag to be supported, loading of a bag arcing and bending said stanchion gradually upon loading, said collar remaining generally horizontal to avoid spillage, said collar and the bending of said stanchion by arcing maintaining a bag in column and supporting a bag primarily upon said base, movement of said ends and spring-back of said stanchion allowing easy removal of said collar from a loaded bag.

2. A stand as in claim 1 wherein the connections between the base and stanchion and the stanchion and collar are disengageable for storage purposes.

3. A stand as in claim 2 wherein said base comprises two members connected at right angles to each other, one of said members being connectable at one end thereof to said stanchion.

4. A stand as in claim 1 wherein the ends of the collar are bent inwardly for ease of hand manipulation.

* * * * *

UNITED STATES PATENT AND TRADEMARK OFFICE

CERTIFICATE OF CORRECTION

PATENT NO. : 4,874,141

DATED : October 17, 1989

INVENTOR(S) : Richard H. Schulz

It is certified that error appears in the above-identified patent and that said Letters Patent is hereby corrected as shown below:

Column 3, line 29, following "noted" delete "i" and insert therefor --in--.

Column 3, line 60, delete "26" and insert therefor --26'--.

Column 3, line 64, following "it" delete "s" and insert therefor --is--.

Signed and Sealed this

Thirtieth Day of October, 1990

*Attest:*

HARRY F. MANBECK, JR.

*Attesting Officer*

*Commissioner of Patents and Trademarks*